US005775788A

United States Patent [19]

Sasse et al.

[11] Patent Number: 5,775,788

[45] Date of Patent: Jul. 7, 1998

[54] TRACK ASSEMBLY FOR A DRAWER

[75] Inventors: Wilfried Sasse, Kirchlengern; Peter Kuppen, Bielefeld; Eckhard Meier, Bünde; Günter Kolkhorst, Rahden; Thomas Kohlmeier, Porta Westfalica; Frank Noske, Löhne, all of Germany

[73] Assignee: Paul Hettich GmbH & Co., Kirchlengern, Germany

[21] Appl. No.: 645,024

[22] Filed: May 15, 1996

[30] Foreign Application Priority Data

May 17, 1995 [DE] Germany ..... 295 07 916 U

[51] Int. Cl.[6] ..... A47B 88/10

[52] U.S. Cl. ..... 312/334.38; 312/334.36; 312/334.11; 312/334.44

[58] Field of Search ..... 312/334.7, 334.6, 312/334.11, 334.44, 334.46, 334.36, 334.37, 334.38; 384/18, 19, 20, 21

[56] References Cited

U.S. PATENT DOCUMENTS

| | | | |
|---|---|---|---|
| 3,588,198 | 6/1971 | Stewart | 384/18 |
| 3,679,285 | 7/1972 | Fall et al. | 384/18 |
| 4,272,139 | 6/1981 | Fler | 384/18 X |
| 4,469,384 | 9/1984 | Fler et al. | 384/18 X |
| 4,953,990 | 9/1990 | Wojcik | 384/21 X |
| 5,169,238 | 12/1992 | Schenk | 384/21 |
| 5,209,572 | 5/1993 | Jordan | 384/18 |
| 5,344,228 | 9/1994 | Kovarik et al. | 312/334.9 |
| 5,417,496 | 5/1995 | Hobbs | 384/18 |
| 5,419,639 | 5/1995 | Hobbs et al. | 384/18 |
| 5,507,571 | 4/1996 | Hoffman | 312/334.8 |
| 5,570,943 | 11/1996 | Schroder et al. | 312/334.37 X |

*Primary Examiner*—Peter M. Cuomo
*Assistant Examiner*—Hanh V. Tran
*Attorney, Agent, or Firm*—Henry M. Feiereisen

[57] ABSTRACT

A track assembly includes a guide rail secured to a piece of furniture, a runner secured to a drawer and formed with end stops that run against stationary stops to limit the movement of the runner, an inner slide rail interconnecting the runner and the guide rail to one another to effect a linear travel of the runner relative to the guide rail. Positioned between the slide rail and the runner and the guide rail are cages for retaining balls therein. Each cage is provided in its end zones with supplemental elastic stops which cooperate with end stops so that stationary stops are first impacted by the elastic stops to align possibly tilted drawers before being impacted by the end stops.

8 Claims, 5 Drawing Sheets

TRACK ASSEMBLY FOR A DRAWER

BACKGROUND OF THE INVENTION

The present invention refers to a track assembly, and in particular to a track assembly of a type including a guide rail secured to a piece of furniture, a runner secured to a drawer, an inner slide rail interconnecting the runner and the guide rail to one another to effect a linear travel between these components, with the relative movement being limited by end stops that run against stationary stops, and with at least one elongated cage positioned between the inner slide rail and the runner or the guide rail for retaining a rolling element therein.

A track assembly of this type is generally known and used in many different configurations. The runner may be of single-piece construction or of the double extension type slide which has the advantage that the drawer may be fully extracted from the piece of furniture. In the double extension type slide, the runner has two rails, whereby the inner slide rail may be fixedly secured to the guide rail so that in an initial pull-out phase both runner rails travel, and then in a subsequent phase only the outer runner rail, which is distant to the guide rail, continues to travel for effecting a complete extraction of the drawer. It is also possible to provide the inner slide rail as a mobile part so that the one runner rail which is directly connected to the guide rail remains stationary.

Examples of rolling elements include balls or rollers. In particular in a track assembly with two extendible rails, so-called telescopic slides, a synchronous extraction of the track assemblies on both sides of the drawer is possible only when incorporating additional components such as gears, rope guides, synchronizing rollers or the like, increasing the complexity of the track assembly.

Moreover, the end stops of the runner impact hard against the stationary stops and produce undesired noises. Especially in track assemblies without synchronizing elements, the generation of such a noise is troublesome because a succession of two hard impacts are encountered in immediate succession.

SUMMARY OF THE INVENTION

It is an object of the present invention to provide an improved track assembly for a drawer, obviating the aforestated drawbacks.

In particular, it is an object of the present invention to provide an improved track assembly for a drawer which enables a simultaneous impact of at least the end stops against the stationary stops during extraction and retraction of the drawer, without requiring additional synchronizing elements.

These objects and others which will become apparent hereinafter are attained in accordance with the present invention by providing a track assembly comprising an inner slide rail for interconnecting a runner, which is secured to a drawer, and a guide rail, which is secured to a piece of furniture, and sets of balls retained by a cage which is interposed between the inner slide rail and the runner or the guide rail and includes in the end regions supplemental elastic stops that are associated to the end stops.

Through provision of the additional elastic stops, the track assembly can be configured in a simple manner without complicated synchronizing elements to effect a simultaneous impact of the end stops upon the metallic stationary stops because as the elastic stops run onto the stationary stop before the end stops, a possible tilted drawer becomes aligned to thereby position the end stops on both sides at a same distance to the stationary stops. As a result of the impact of the elastic stops on the stationary stops, the pull-out velocity of the drawer is significantly reduced before the end stops run against the stationary stops so that the end stops impact in a soft fashion upon the stationary stops without generating any unpleasant noise. Moreover, as the cage is already formed with receptacles for deposition of the elastic stops, the track assembly according to the present invention can be configured in a very simple manner.

According to one embodiment of the present invention, the elastic stops are positioned at a distance to the end stops, so that each elastic stop and pertaining end stop cooperate with a same stationary stop by impacting in succession. Typically, the stationary stop may be formed on the guide rail or on the piece of furniture, e.g. in form of raised bosses or any other suitable configuration. In accordance with an alternative embodiment, the elastic stops and the end stops are positioned at a same distance from the end faces of the cage, with each elastic stop and associated end stop cooperating with two spaced stationary stops that are positioned offset to each other and respectively disposed in the travel path of the elastic stop and in the travel path of the end stop.

In both embodiments, the difference of the travel path between the elastic stops and the end stops in relation to the stationary stops is exploited to align the drawer. In the first case, the stationary stop is first impacted by the elastic stop and subsequently by the end stop for final securement, while in the second case the stationary stop in the travel path of the elastic stop is impacted first by the elastic stop to effect an alignment of the drawer. Then, the elastic stop advances past this stationary stop to enable the end stop to run against the other stationary stop which is positioned offset to the first stationary stop in the travel path of the end stop.

Suitably, the elastic stops are arranged outside the end stops at their sides facing away from each other so that the elastic stops become effective during extraction and retraction before the end stops.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
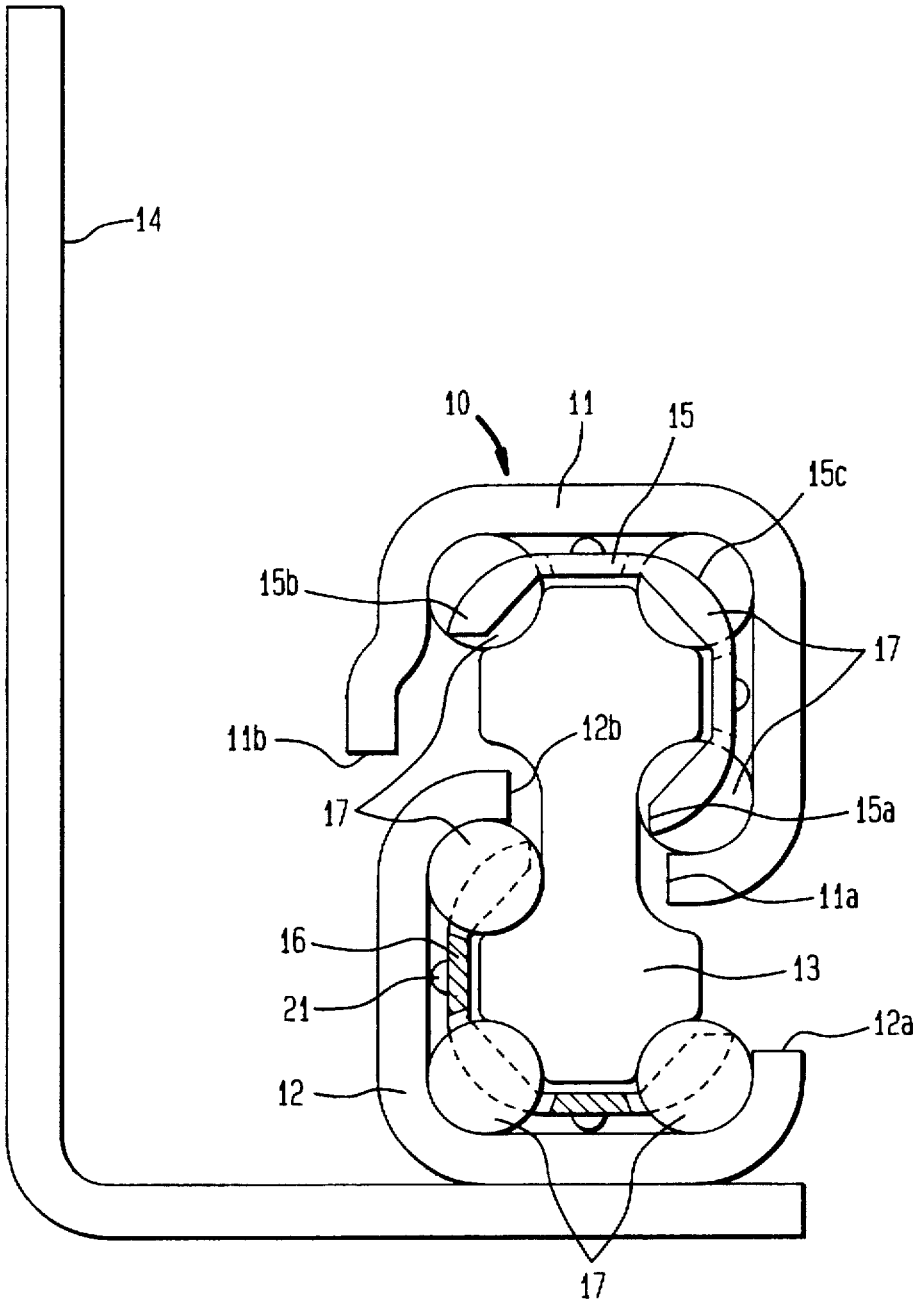
FIG. 1 is a cross sectional view of one embodiment of a track assembly according to the present invention.

Throughout all the Figures, the same or corresponding elements are always indicated by the same reference numerals.

Turning now to the drawing, and in particular to FIG. 1, there is shown a cross sectional view of a track assembly according to the present invention, generally designated by reference numeral 10 for allowing full extraction of a drawer from a cabinet or other piece of furniture. The track assembly 10 includes a pair of slide members in the form of a metallic slide rail or runner 11 which is secured in the drawer (not shown), and a fixed metallic guide rail 12 which is attached to the piece of furniture (not shown), and an inner slide rail 13 which interconnects the runner 11 to the guide rail 12 and is slidable relative to the guide rail 12 to effect a linear travel of the runner 11 with respect to the guide rail 12. Although not shown in the drawing, the inner slide rail may also represent a stationary part, with the runner comprised of two runner rails in telescopic configuration. One end of the runner 11 is suitable of cranked configuration to enable attachment of a draw-in unit in form of a conventional spring-type mechanism by which the drawer is loaded to seek its closing position.

A bracket 14 of L-shaped or angular configuration is securely fixed to the guide rail 12, e.g. by welding or suitable fasteners (not shown), for attachment to the piece of furniture.

The runner 11 and the guide rail 12 are of approximate L-shaped configuration to form raceways for three sets of balls 17 placed at least in the end zones of the runner 11 and the guide rail 12 with one end of 11*a* of the runner 11 and the opposite ends 12*a*, 12*b* of the guide rail being bent inwardly and the other end 11*b* of the runner 11 being extended. The balls 17 are retained by two cages 15 and 16, with cage 15 being positioned between the runner 11 and the slide rail 13, and with cage 16 being positioned between the guide rail 12 and the inner slide rail 13. Spacers 21 in form of bosses or ridges on the cages 15, 16 maintain a distance to the runner and guide rail 12, respectively.

Figure 2:
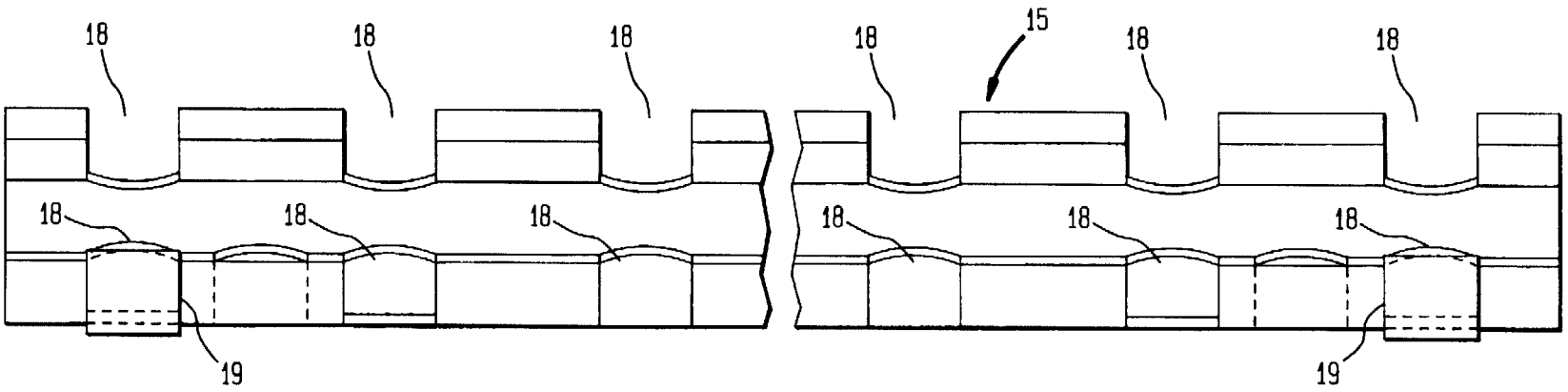
FIG. 2 is a plan view of a cage for use in the track assembly of FIG. 1.

FIG. 2 shows by way of example a plan view of the cage 15. The cage 15 is formed by a profiled rail which is open on one side and is formed of approximate L-shaped configuration and exhibits extreme edges 15*a*, 15*b* (FIG. 1) that are bent inwardly. Formed in an area along the extreme edges 15*a*, 15*b* and along the central corner area 15*c* are a plurality of recesses 18 for receiving the sets of balls 17. FIG. 2 shows only the recesses 18 along the corner area and the area along one extreme edge.

Figure 3:
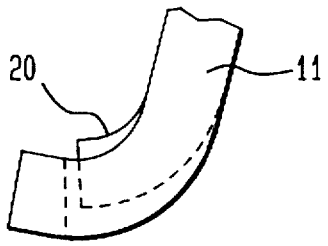
FIG. 3 is a fragmented illustration of a runner rail of the track assembly of FIG. 1 for illustration of an end stop.
Figure 6:
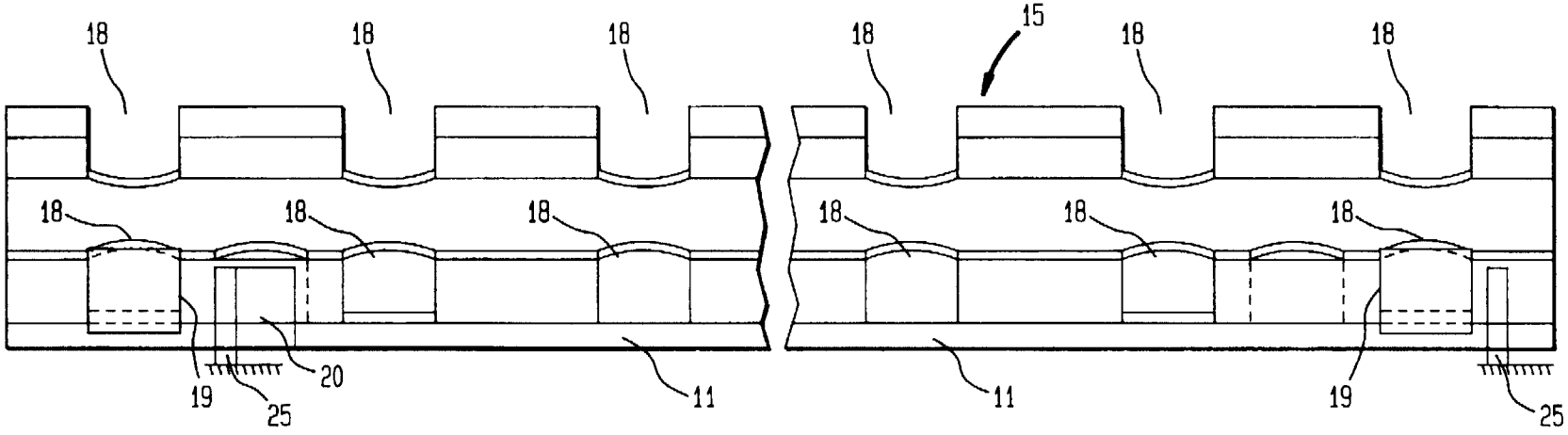
FIG. 6 is a schematic representation of one embodiment of the track assembly in retracted disposition, showing in detail the cage with its stops in relation to stationary end stops.

As shown in FIG. 3, the runner 11 is formed with tongue-like projections 20 (only one is shown in FIG. 3), which are punched out from the runner 11 and form respective end stops to limit the displacement of the runner 11 during extraction or retraction of the drawer by impacting against a stationary stop 25 provided in form of a boss or other suitable raised part and situated on the guide rail 12 or bracket 14, or on the piece of furniture. As shown in FIG. 6, the bracket 14 (or the piece of furniture) is formed with two such stationary stops 25 while FIG. 7 shows an alternative configuration with the bracket 14 (or the piece of furniture) having three stationary stops 25.

Figure 4:
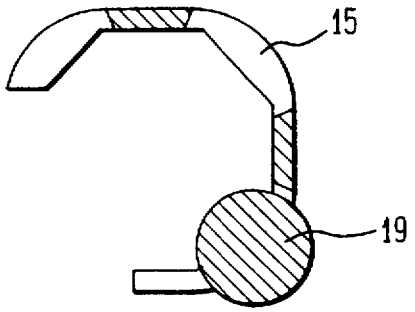
FIG. 4 is a cross sectional view of the cage of FIG. 2.

As shown in FIGS. 2 and 4, each of the cages 15, 16 is provided at each axial end with a supplemental elastic stop 19 e.g. in the form of a small resilient cylindrical ball. The two elastic stops 19 are received in the outermost recesses 18 on one side of each cage 15 and effect an alignment of the drawer when the elastic stops 19 impact on the stationary stops 25 because the track assembly 10 is positioned on both sides of the drawer shown in FIG. 6 after the impact of the elastic stops 19 on the stationary stops, the end stops 20 to subsequently impact on the stationary stops at 25, the elastic stops as a consequence of their elasticity are able to move past the respective stationary stop 25 to allow. The end stops 20 are spaced at a slight distance from the elastic stops 19 in the same travel path and positioned within the facing sides of the elastic stops 19. Thus, when extracting or retracting the drawer, the elastic stops 19 impact first on the stationary stops, thereby properly aligning the drawer and allowing a subsequent impact of the end stops 20 on the stationary stops 25.

Figure 7:
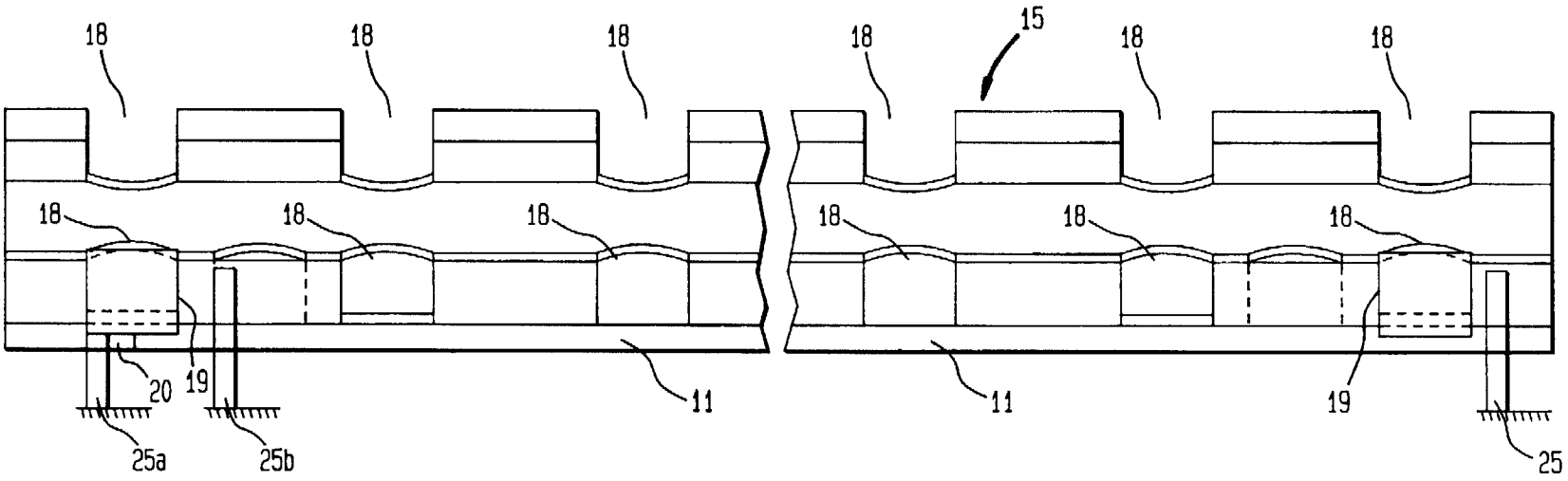
FIG. 7 is a schematic representation of another embodiment of the track assembly in retracted disposition, showing in detail the cage with its stops in relation to stationary end stops.

FIG. 7 shows another embodiment of the track assembly, in which the end stops 20 are positioned at a same alignment with the elastic stops 19, i.e. at a same distance from the axial ends of the cage 15, whereby two stationary stops 25*a*, 25*b* are provided that are positioned offset to each other and respectively disposed in the travel path of the elastic stop 19 and the travel path of the pertaining end stop 20. Thus, during extraction or retraction of the drawer and displacement of the runner 11 and the inner slide rail 13, the elastic stops 19 first contact the stationary stops 25 in their travel path to effect the alignment of the drawer, and subsequently the end stops 20 run against the stationary stops 25 positioned in their travel path.

Figure 5:
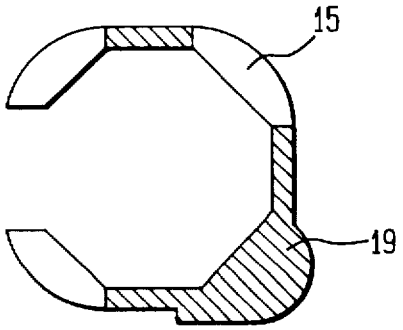
FIG. 5 is a variation of a cage with an integral elastic stop.

As shown in FIG. 5, the cage 15 may also be formed integrally with the elastic stops 19 in form of bosses projecting from the cage surface, with the cage 15 exhibiting an approximate C-shaped configuration. The elastic stops 19 shown in FIGS. 4 and 5 are examples of possible configurations, and the present invention should not be limited thereto. It is certainly within the scope of the present invention to provide elastic stops e.g. of elongated configuration for placement in the recesses.

While the invention has been illustrated and described as embodied in a track assembly for a drawer, it is not intended to be limited to the details shown since various modifications and structural changes may be made without departing in any way from the spirit of the present invention.

What is claimed as new and desired to be protected by letters patent is set forth in the appended claims:

1. A track assembly for a drawer, comprising:

a guide rail securable to a piece of furniture;

a runner securable to a drawer and slidable with respect to the guide rail between extended and retracted positions defined by stationary stop members, said runner being formed with a metallic end stop;

an inner slide rail for interconnecting the guide rail with the runner, and a cage assembly connected to the inner slide rail and retaining at least one roller element, said cage assembly having opposite end areas, each of which having incorporated therein an elastic stop member for impact upon the stationary stop members before impact of the metallic end stop.

2. The track assembly of claim 1 wherein one of said elastic stop members is positioned at a distance from the end stop for cooperation with the stationary stop.

3. The track assembly of claim 1 wherein one of said elastic stop members is spaced from an end face of the cage at a same distance as the end stop, with the end stop interacting with two such stationary stops that are spaced from one another.

4. The track assembly of claim 2 wherein the end stop is positioned between the elastic stop members.

5. A track assembly for a drawer, comprising:

a pair of slide members respectively securable to a drawer and a piece of furniture, one of the slide members being formed with a first stop member;

an inner slide rail for interconnecting the slide members, and a cage assembly positioned between one of the slide members and the inner slide rail for retaining at least one roller element, said cage assembly having opposite axial ends, each axial end including an elastic second stop member, wherein the first stop member and the elastic second stop member so cooperate with a stationary third stop member that the elastic second stop member impacts the stationary stop member before the first stop member so as to align the drawer during extension thereof.

6. The track assembly of claim 5 wherein one of said elastic stop members of the cage assembly is spaced from the first stop member and positioned in closer proximity to the axial end area of the cage so that the elastic stop member and the first stop member impact the stationary stop member successively.

7. The track assembly of claim 5 wherein one of said elastic stop members is positioned in alignment with the first stop member for cooperation with two such stationary stop members in offset relationship, with one stationary stop member being positioned in a travel path of the elastic stop member and the other stationary stop member being positioned in a travel path of the first stop member.

8. The track assembly of claim 5 wherein the first stop member is arranged between the elastic stop members.

* * * * *